US005406811A

United States Patent [19]

Nakai

[11] Patent Number: 5,406,811

[45] Date of Patent: Apr. 18, 1995

[54] LOCKING APPARATUS FOR VEHICLES

[75] Inventor: Hatsuo Nakai, Toyonaka, Japan

[73] Assignee: Clover Co., Ltd., Osaka, Japan

[21] Appl. No.: 67,896

[22] Filed: May 27, 1993

[30] Foreign Application Priority Data

Mar. 24, 1993 [JP] Japan ..... 5-090899

[51] Int. Cl.[6] ..... E05B 37/06

[52] U.S. Cl. ..... 76/26; 70/28; 70/30; 70/53; 70/312

[58] Field of Search ..... 70/25, 26, 28, 53, 27, 70/30, 24, 312

[56] References Cited

U.S. PATENT DOCUMENTS

| | | | |
|---|---|---|---|
| 839,795 | 12/1906 | Wilcox | 70/28 |
| 891,439 | 6/1908 | Quaintance | 70/28 |
| 1,728,902 | 9/1929 | Cohen | 70/53 |
| 1,773,204 | 8/1930 | Scheibner | 70/26 |
| 2,008,565 | 7/1935 | Segal | 70/25 |
| 4,610,152 | 9/1986 | Düringer | 70/312 X |
| 4,621,509 | 11/1986 | Mizuno | 70/26 |
| 4,760,718 | 8/1988 | Muramatsu et al. | 70/18 |
| 4,918,951 | 4/1990 | Kavizky | 70/53 |
| 5,027,623 | 7/1991 | Ling | 70/26 |
| 5,142,888 | 9/1992 | Ling | 70/26 |

FOREIGN PATENT DOCUMENTS

| | | | |
|---|---|---|---|
| 969865 | 12/1950 | France | 70/25 |
| 340431 | 5/1936 | Italy | 70/26 |
| 239217 | 2/1926 | United Kingdom | 70/39 |

*Primary Examiner*—Lloyd A. Gall
*Attorney, Agent, or Firm*—Jordan and Hamburg

[57] ABSTRACT

A locking apparatus for vehicles of the present invention is constituted by a rigid lock body and a hook. The hook is connected to the lock body in a ring shape such that, at least one end thereof can be separated from the lock body. The lock body includes a moving plate which engages with and disengages from the separating end side of the hook, responding to the external operation for unlocking and locking, and an operating shaft capable of reciprocating in an interlocking fashion with the moving plate. On the operating shaft, a plurality of dials are respectively disposed rotatably via bushes. Between the dials and the bushes, an unlocking code sequence setting mechanism for setting an unlocking code sequence freely is formed, and between the operating shaft and the bush, a lock mechanism is formed. The lock mechanism allows reciprocating motion of the operating shaft when the dial codes are in an aligned state constituting the unlocking code sequence, and restricts reciprocating motion of the operating shaft in a misaligned state.

14 Claims, 15 Drawing Sheets

LOCKING APPARATUS FOR VEHICLES

BACKGROUND OF THE INVENTION

1. Field of the Invention

The present invention relates to a locking apparatus for vehicles which is attached to a wheel portion of a bicycle or a motor bicycle (hereinafter merely referred to as vehicles) to prevent a theft of the vehicles, and particularly, it relates to a locking apparatus in which a code lock mechanism is introduced.

2. Description of the Invention

Conventionally, as a locking apparatus for vehicles, generally a chain lock is used. The chain lock is constituted such that, a lock mechanism such as a code lock is installed on one end of a chain which is wound around between a wheel portion and a body portion of the vehicles, and after connecting the other end of the chain to the lock mechanism, an unlocking code sequence is disordered for locking.

However, in the case of the chain lock, since the chain is constituted by connecting a plurality of metal rings, it can be easily cut off by a simple cutting tool and a sufficient burglarproof effect can not be attained.

Therefore, in recent years, a locking apparatus for vehicles constituted as shown in FIG. 16, in which the chain is replaced by a single metal bar, was put on the market.

The locking apparatus for vehicles shown in the figure comprises, a metal lock body 1 incorporating a lock mechanism 9, and a hook 2 formed by bending the metal bar into a U-shape. The lock body 1 includes a pair of engaging depressions 3, 4 around the opposite ends, and a key hole 6 provided at one end face for engaging and disengaging a key 5 to and from the lock mechanism 9.

The hook 2 includes engaging projections 7, 8, which are disengageable with the engaging depressions 3, 4 of the lock body 1, at the opposite end thereof, and at the engaging depressions 3, 4 of the lock body 1, an engaging cam shaft 10, which is disengageble with the engaging projections 7, 8 and coupled to the lock mechanism 9, is disposed radially.

In the case of the locking apparatus for vehicles having the above-mentioned configuration, since the hook 2 is formed by bending the metal bar, though it can not be cut off easily and exhibits a powerful burglarproof, since it is constructed to lock and unlock by using the key 5, it is troublesome to keep the key 5 so as not to lose the same.

Now, though it is possible to introduce the code lock used in the aforementioned chain lock in place of the lock mechanism using the key, in case of the code lock, when the unlocking code sequence is remembered by others, the burglarproof effect is reduced by half.

SUMMARY OF THE INVENTION

It is an object of the present invention to provide a locking apparatus for vehicles capable of coping with the situation easily by changing an unlocking code sequence, even when it is remembered by others, and thereby to largely enhance reliability of such kind of locking apparatus.

According to this object, the locking apparatus for vehicles according to the present invention comprises, a rigid lock body and a hook which is a single metal bar or a coupled body of a plurality of metal bars. The hook is connected to the lock body in a ring shape in such a manner that, at least, one end thereof can be separated from the lock body.

The lock body includes: a moving plate which engages with and disengages from a separating end side of the hook responding to the external operation for unlocking and locking; an operating shaft which can reciprocate in an interlocking fashion with the moving plate; a plurality of dials respectively disposed on the operating shaft rotatably via bushes; an unlocking code sequence setting mechanism which changes coupling angular positions of the dials against the bushes to set the unlocking code sequence variably; and a locking mechanism which allows reciprocating motion of the operating shaft when the dial codes are in an aligned state constituting the unlocking code sequence, and restricts reciprocating motion of the operating shaft when the dial codes are in a misaligned state.

Since, a code lock mechanism is introduced for unlocking and locking by the aforesaid configuration, a key is not necessary as in the conventional example, and since the unlocking code sequence setting mechanism is provided, even when the unlocking code sequence is remembered by others, it can be easily coped with, and thus reliability of the locking apparatus for vehicles is largely improved.

Furthermore, in the invention claimed in claim 2, since opposite ends of the hook can be separated from the lock body, it can be easily attached to the vehicles, while in the invention claimed in claim 3, since one end of the hook is constrained by the lock body and the other end thereof can be separated from the lock body, there is no possibility of losing the hook.

In the invention claimed in claim 4, since the hook is a coupled body of a plurality of metal bars, and respective connections can be bent one with respect to another, it is very easy to handle.

In the invention claimed in claims 5 and 6, since a push button or an operating lever for pressing the moving plate against the lock body for operation is disposed on the lock body, the hook can be easily engaged to and disengaged from the lock body.

DESCRIPTION OF THE PREFERRED EMBODIMENTS

Figure 1:
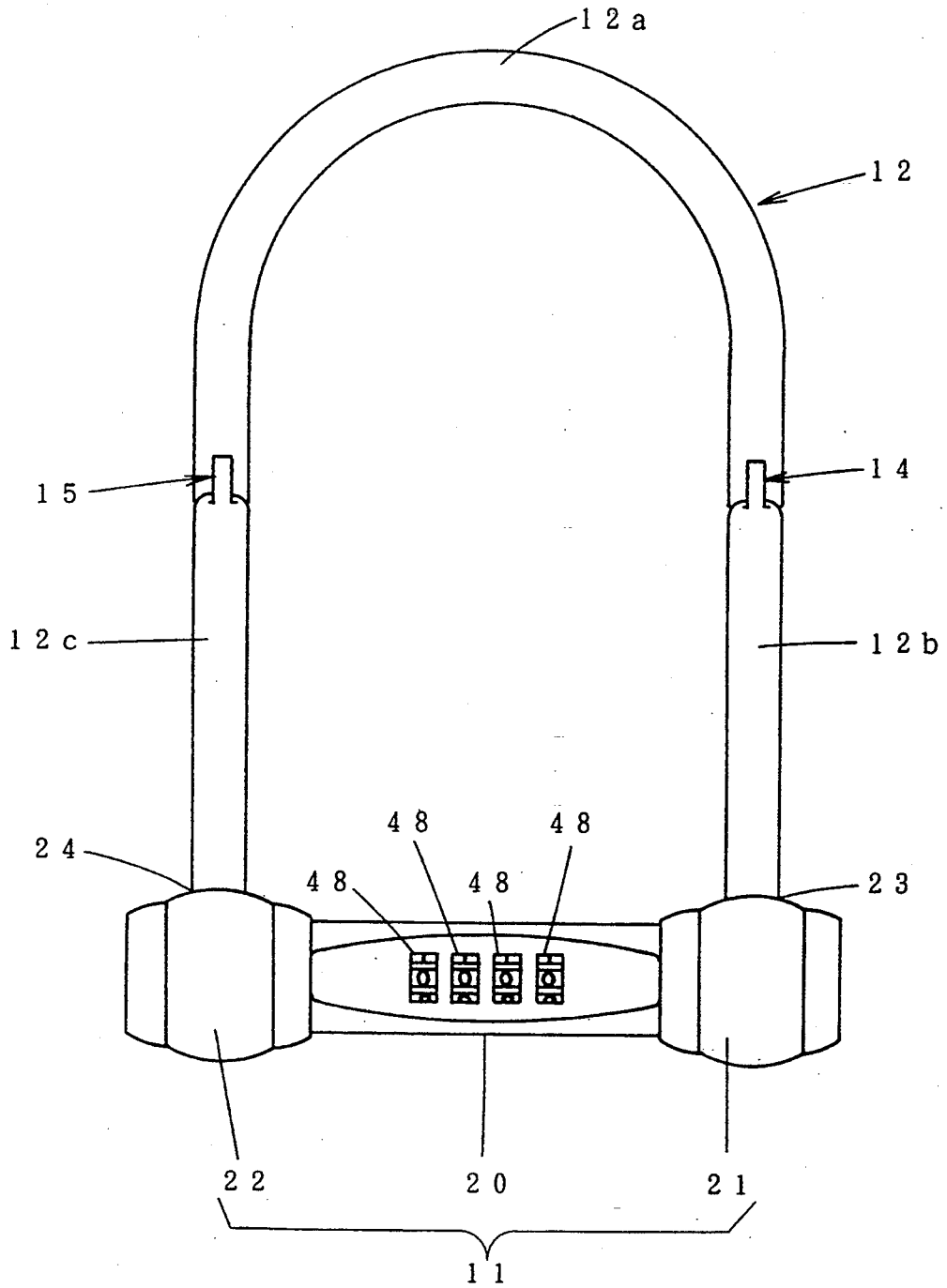
FIG. 1 is a front view showing an appearance of a locking apparatus for vehicles according to the present invention.
Figure 2:
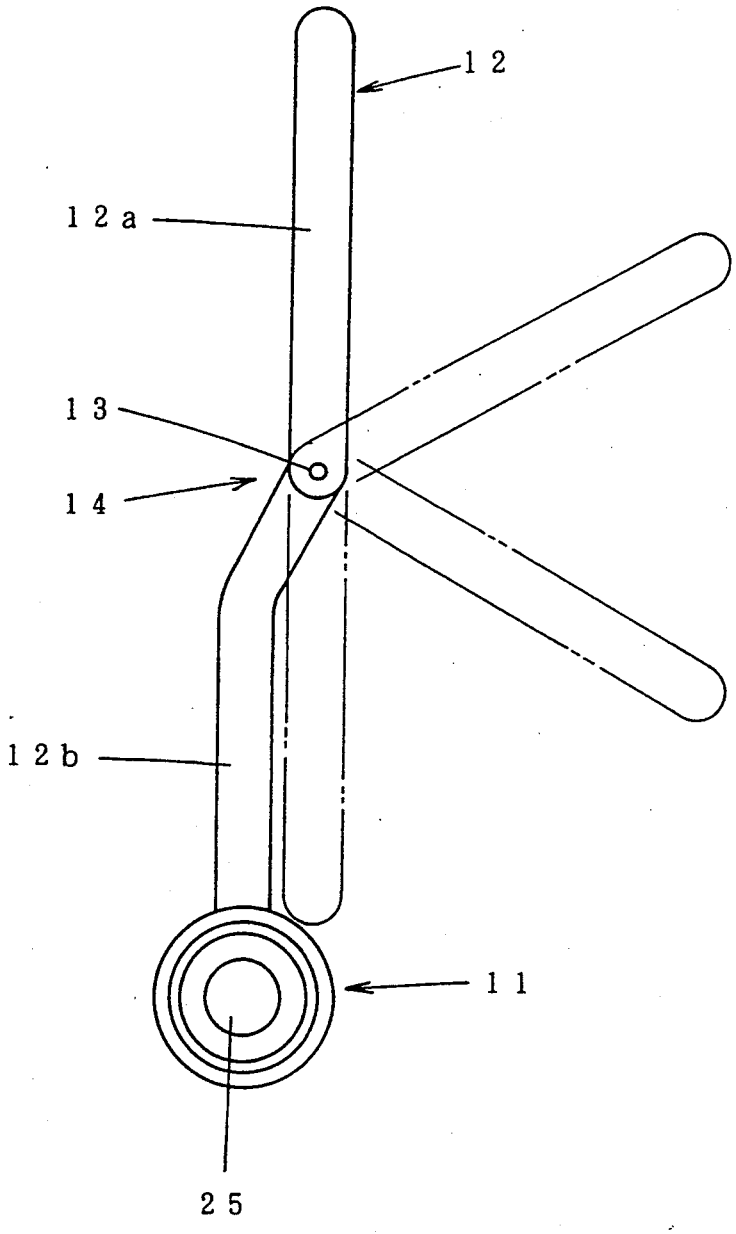
FIG. 2 is a right side view showing an appearance of a locking apparatus for vehicles shown in FIG. 1.
Figure 3:
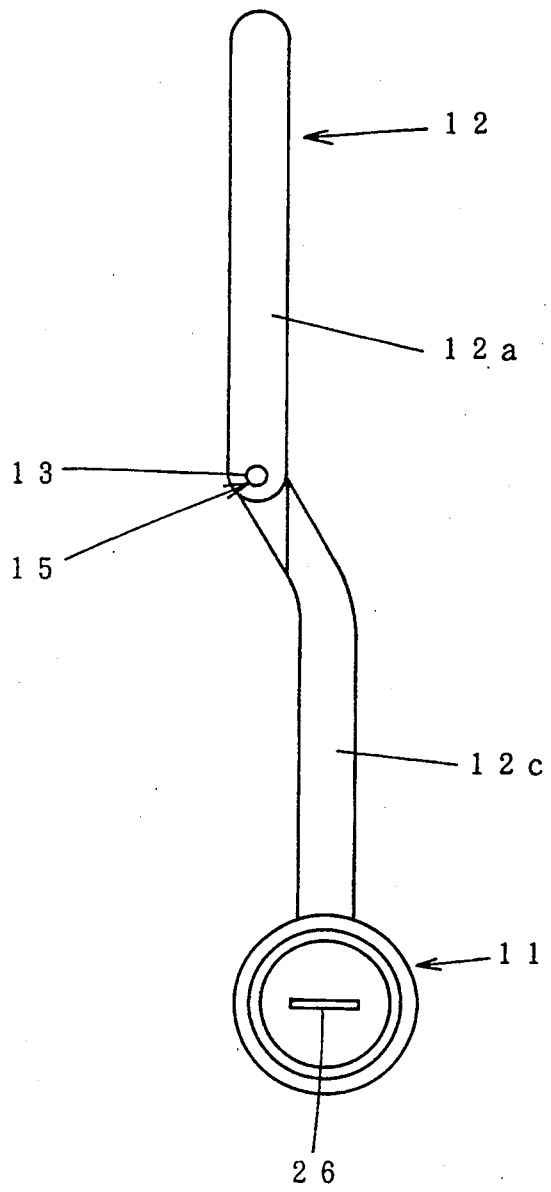
FIG. 3 is a left side view showing an appearance of a locking apparatus for vehicles shown in FIG. 1.

FIG. 1 to FIG. 3 show an appearance of a locking apparatus for vehicles which is a first embodiment of the present invention.

The locking apparatus for vehicles is constituted by a straight lock body 11 and a U-shaped hook 12. The hook 12 is connected to the lock body 11 in a ring shape such that, opposite ends thereof can be separated from the lock body 11. The hook 12 is constituted such that, a pair of metal bars **12*b*, 12*c*, whose one ends are bent slightly, are respectively coupled to the opposite ends of a U-shaped metal bar 12*a* by means of pivots 13 and ears 14, 15. The hook 12** may not necessarily be a coupled body of a plural number of metal bars, but it may be constituted by a single U-shaped metal bar.

In this embodiment, the intermediate metal bar **12*a* and the two metal bars 12*b*, 12*c* can be pivoted relative to each other about ears 14, 15**.

Figure 4:
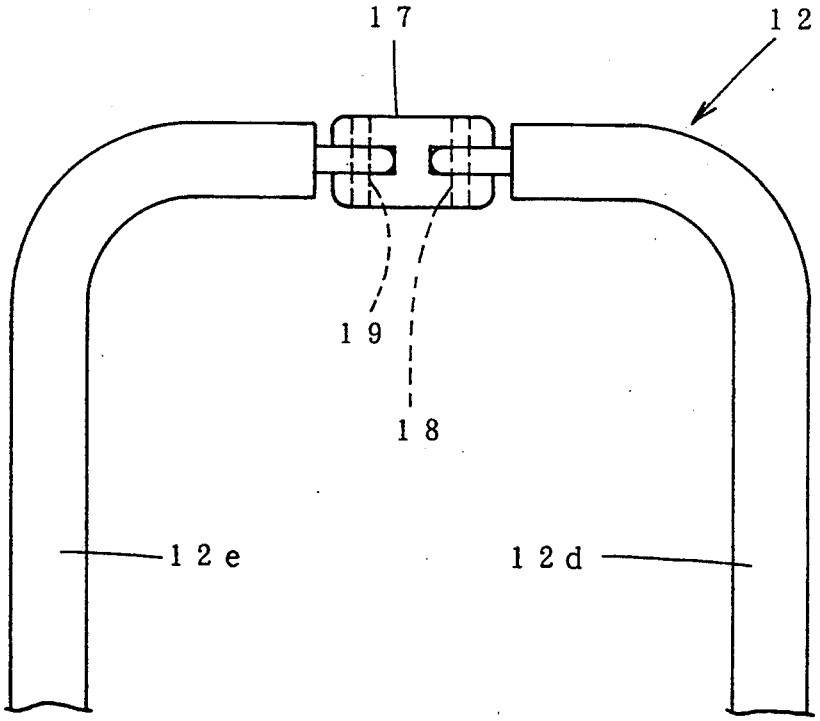
FIG. 4 is a partially expanded front view showing another embodiment of a hook.

The hook 12 shown in FIG. 4 includes a coupling member 17 provided between the two metal bars **12*d*, 12*e*, which are coupled together in a bending fashion by means of two pivots 18, 19** so as to be folded on each other.

Next, the lock body 11 includes a dial operating unit 20 at the lengthwise center and hook connecting portions 21, 22 at the opposite ends. The hook connecting portions 21, 22 are provided with circular hook insertion holes 23, 24 into which the opposite ends of the hook 12 can be inserted.

At an end face of one hook connecting portion 21, a push button 25 is projected as shown in FIG. 2, while at an end face of the other hook connecting portion 22, a coin slot 26 is opened as shown in FIG. 3.

Figure 5:
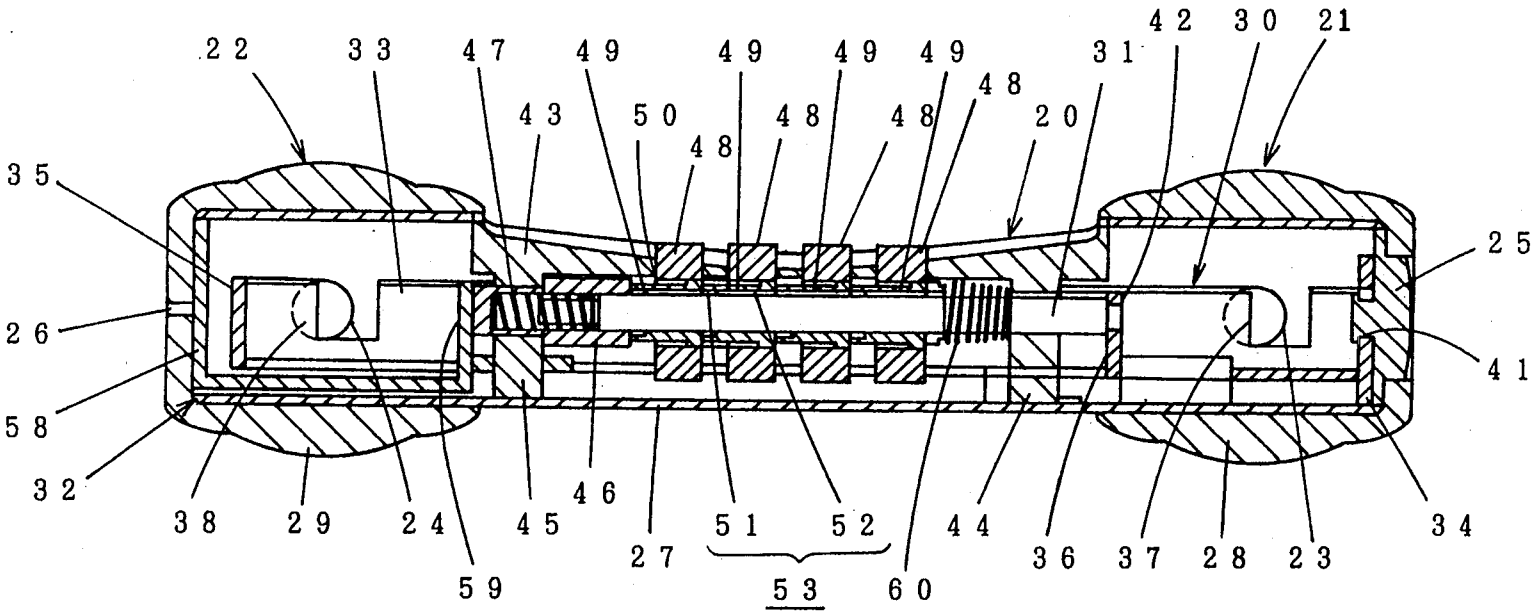
FIG. 5 is a sectional view showing an internal structure of a lock body.

FIG. 5 shows an internal structure of the lock body 11.

An external wall of the lock body 11 shown in the figure is constituted by, a cylindrical metal frame 27 and caps 28, 29 made of a synthetic resin and engaged to the opposite ends of the metal frame 27. The dial operating unit 20 is formed in a window hole opened by cutting a peripheral surface of the metal frame 27 by a fixed length.

Figure 6:
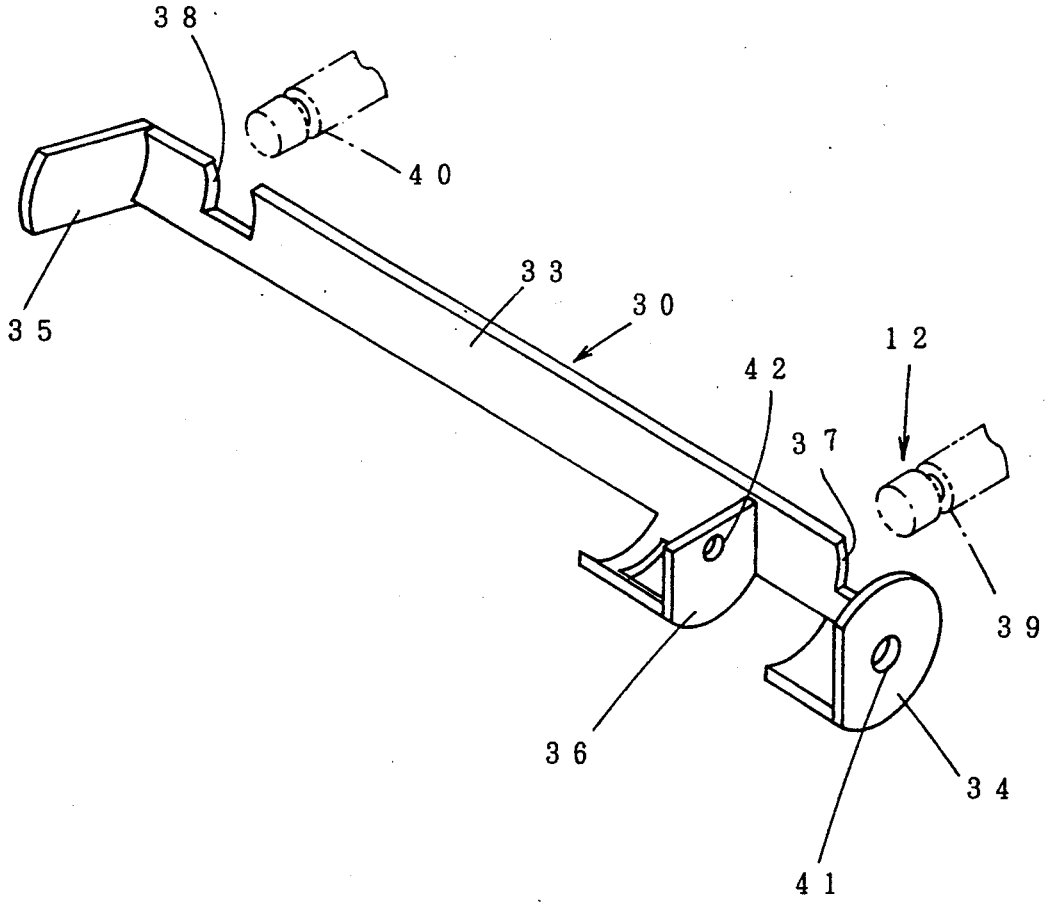
FIG. 6 is a perspective view showing an appearance of a moving plate.
Figure 7:
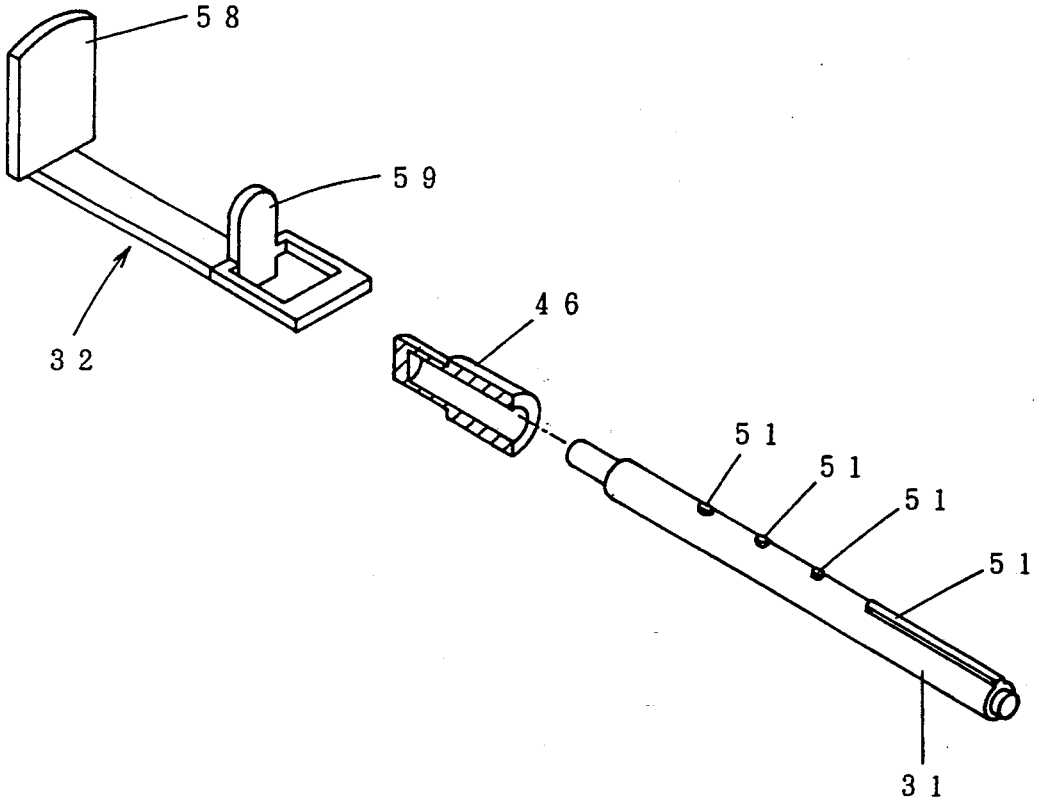
FIG. 7 is a partially broken exploded perspective view showing an operating plate, a sleeve and an operating shaft.

In the cylindrical metal frame 27, a moving plate 30 as shown in FIG. 6 and an operating shaft 31 and an operating plate 32 as shown in FIG. 7 are disposed in association with each other.

The moving plate 30 includes a side plate 33 extending substantially an entire length of the metal frame 27, the side plate 33 being provided with end plates 34, 35 formed at opposite ends thereof, and a push plate 36 formed in the vicinity of one end plate 34 in a body. At one side edge of the side plate 33, engaging portions 37, 38 which engage with and disengage from the opposite ends of the hook 12 are formed.

Peripheral grooves 39, 40 are formed at the opposite ends of the hook 12, whereby when the opposite ends of the hook 12 are inserted into the hook insertion holes 23, 24 of the lock body 11, the engaging portions 37, 38 and the peripheral grooves 39, 40 are engaged.

In one end plate 34, a connecting hole 41 is provided to receive the push button 25, and in the push plate 36, a connecting hole 42 is provided to receive one end of the operating shaft 31.

The opposite ends of the above-mentioned operating shaft 31 are borne reciprocatingly by support walls 44, 45 at opposite ends of a dial fitting pedestal 43. On one end of the operating shaft 31, a bias sleeve 46 is provided, and a compression spring 47 disposed in the sleeve 46 engages the operating shaft 31 to always urge it toward the push button 25 by the spring pressure.

Four dials 48 are respectively disposed rotatably on the operating shaft 31 via bushes 49. The dials 48 are respectively positioned in rectangular window holes 50 provided in the dial fitting pedestal 43, peripheral portions of the dials 48 being slightly projected on the dial fitting pedestal 43 from the window holes 50.

On the peripheral surface of the dials 48, codes "0" to "9" are marked at equiangular positions so as to bring the desired codes of the dials 48 on the dial fitting pedestal 43 by operating the dials.

Figure 8:
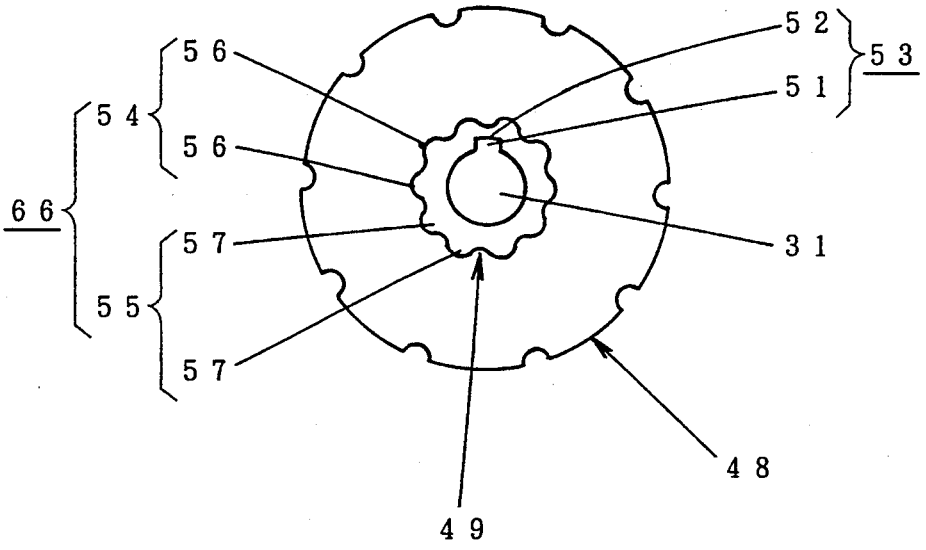
FIG. 8 is a side view showing an engagement structure of a dial and a bush.

On the peripheral surface of the operating shaft 31, as shown in FIG. 7 and FIG. 8, a plurality of projections 51 project outwardly at equiangular positions and at fixed intervals. The projections 51 constitute a lock mechanism 53 together with projection engaging grooves 52 provided lengthwise on the inner surface of the bushes 49.

When the codes of the dials 48 lined up on the dial fitting pedestal 43 are aligned to constitute an unlocking code sequence (in the unlocking state), the lock mechanism 53 allows reciprocating motion of the operating shaft 31, while when the codes of the dials 48 are not aligned and the unlocking code sequence is in the misaligned state (in the locking state), restricts reciprocating motion of the operating shaft 31.

Figure 9:
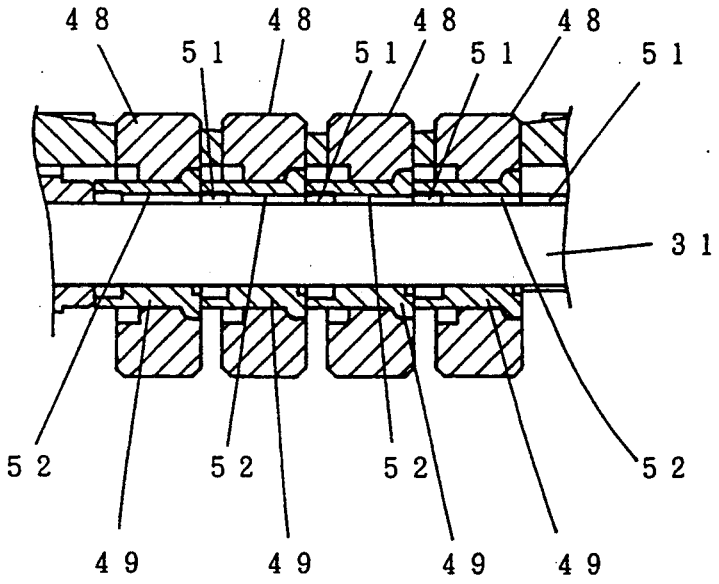
FIG. 9 is a sectional view showing a principle of a lock mechanism.
Figure 10:
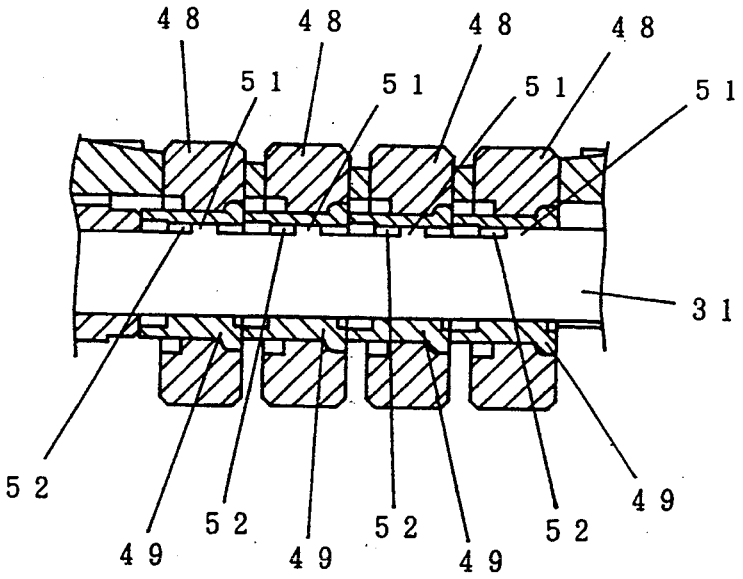
FIG. 10 is a sectional view showing a principle of a lock mechanism.
Figure 11:
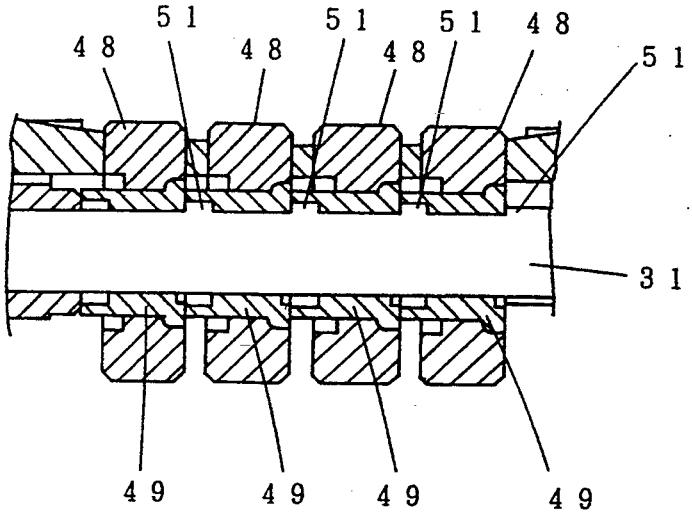
FIG. 11 is a sectional view showing a principle of a lock mechanism.

FIG. 9 to FIG. 11 show a principle of the lock mechanism 53.

FIG. 9 shows the unlocking state of the lock mechanism 53 where the push button 25 is not pressed and the operating shaft 31 is extremely displaced towards the push button (in a right direction in the figure). At this time, though the projections 51 are emerged from the projection engaging grooves 52, since they are aligned at the equiangular position with the projection engaging grooves 52, the projections 51 are in a state admittable to the projection engaging grooves 52. In this state, the opposite ends of the hook 12 inserted into the hook insertion holes 23, 24 are engaged to the engaging portions 37, 38 of the moving plate 30 at the respective peripheral grooves 39, 40.

When the push button 25 is pressed in this state, the operating shaft 31 is pushed and displaced towards the coin slot 26 (in a left direction in the figure) by the moving plate 30, and as shown in FIG. 10, the projections 51 advance into the projection engaging grooves 52. Thereby, the peripheral grooves 39, 40 at opposite ends of the hook 12 disengage from the engaging portions 37, 38 of the moving plate 30, and the opposite ends of the hook 12 can be drawn out from the hook insertion holes 23, 24.

Since the operating shaft 31 can reciprocate but not rotate, in the state where the projections 51 are engaged to the projection engaging grooves 52 (the state shown in FIG. 10), the dials 48 can not be rotated, but in the state where the projections 51 are disengaged from the projection engaging grooves 52 (the state shown in FIG. 9), the dials 48 can be rotated.

When either of the dials 48 is rotated to disorder the unlocking code sequence in the unlocked state shown in FIG. 9, the bush 49 is rotated together with the dial 48 being rotated, and the angular position between the projection engaging groove 52 and the projection 51 is shifted. Thus, the projection 51 can not advance into the projection engaging groove 52, and as a result, the locked state, where movement of the operating shaft 31 is prevented, is formed.

FIG. 11 shows the locked state, in which the peripheral grooves 39, 40 on the opposite ends of the hook 12 inserted into the hook insertion holes 23, 24 and the engaging portions 37, 38 of the moving plate 30 are retained in the engagement state.

Between the dials 48 and the bushes 49, an unlocking code sequence setting mechanism 66 for setting the unlocking code sequence freely is formed.

The unlocking code sequence setting mechanism 66 is constituted by groove trains 54 formed at one end of the inner surface of the dials 48 and projection trains 55 formed at one end of the peripheral surface of the bushes 49. The groove train 54 includes engaging grooves 56, which are disposed around thereof at an equiangular interval by the number coincided with the number of the codes. While, the projection train 55 includes engaging projections 57, which are disposed around thereof at an equiangular interval and engageable with every engaging groove 56 by the number of the codes.

Though the dials 48 and the bushes 49 are integrated when the projection trains 55 of the bushes 49 and the groove trains 54 of the dials 48 mesh with each other, when the bushes 49 displace along the operating shaft 31 and engagement between the two is disengaged, the relationship between the dials 48 and the bushes 49 is cut off and the dials can rotate independently. The number of interlocking angular positions of the projection trains 55 and the groove trains 54, or engaging angular positions of the dials 48 against the bushes 49, are equal in number with the number of codes. Thus, the codes constituting the unlocking code sequence can be set in ten ways responding to the engaging angular position of the dials 48 and the bushes 49.

The operating plate 32 and the sleeve 46 shown in FIG. 7 constitute the unlocking code sequence setting mechanism 66 together with the interlocking structure of the dials 48 and the bushes 49 mentioned above.

In the operating plate 32, a hit plate 58 is formed at one end thereof and a bias plate 59 is formed at the other end, and as shown in FIG. 5, the hit plate 58 faces the coin slot 26 and the bias plate 59 faces the sleeve 46. The sleeve 46 is covered slidably on one end of the operating shaft 31, and its opening end is brought face to face with the end face of the bush 49 at the left end in the figure. In FIG. 5, a compression spring 60 disposed at the other end of the operating shaft 31 is designed to urge the bushes 49 always to the sleeve 46 side.

Figure 12:
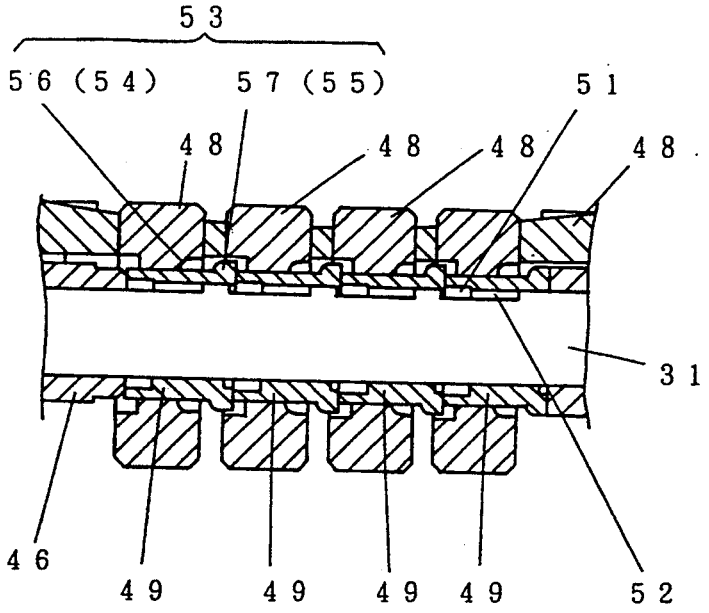
FIG. 12 is a sectional view showing a principle of an unlocking code sequence setting mechanism.

In order to set the unlocking code sequence by the unlocking code sequence setting mechanism 66 constituted as mentioned above, in the unlocked state shown in FIG. 9, a coin is inserted into the coin slot 26 to press the hit plate 58 of the operating plate 32. Thereby, the operating plate 32 is pushed, and further, the sleeve 46 is pushed by the bias plate 59, and still further, the bushes 49 are pushed by the opening end of the sleeve 46. As a result, the bushes 49 displace simultaneously along the operating shaft 31 as shown in FIG. 12. Thereby, since the projection trains 55 of the bushes 49 and the groove trains 54 of the dials 48 disengage from each other, the dials 48 can be rotated independently.

In this state, the dials 48 are rotated to set a desired unlocking code sequence, and thereafter, when the coin is drawn out from the coin slot 26 to release the biassing force against the operating plate 32, the spring force of the compression spring 60 acts on the bushes 49 for return motion of the bushes 49, thereby the projection trains 55 of the bushes 49 and the groove trains 54 of the dials 48 engage with each other to fix the unlocking code sequence.

Figure 13:
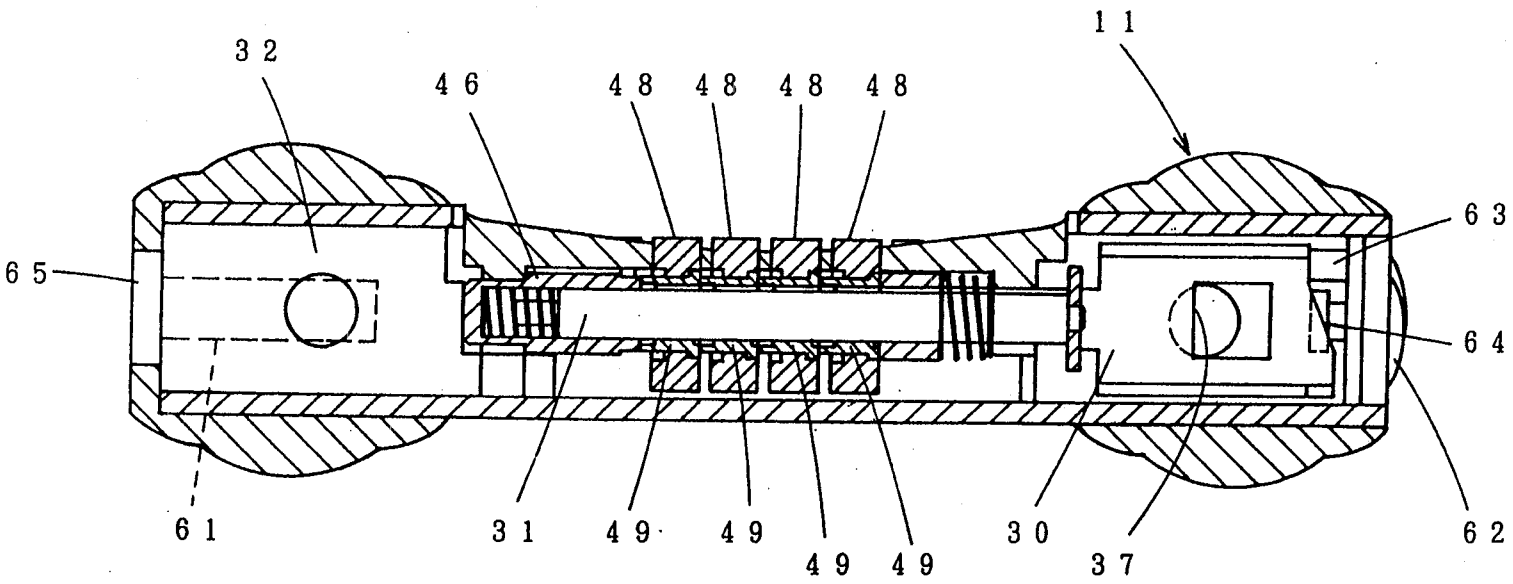
FIG. 13 is a sectional view showing an internal structure of a lock body in a second embodiment of the present invention.
Figure 14:
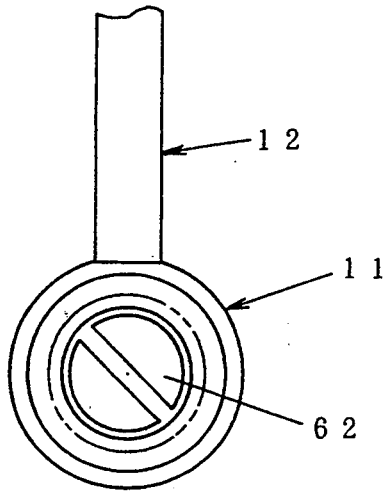
FIG. 14 is a right side view of a second embodiment.
Figure 15:
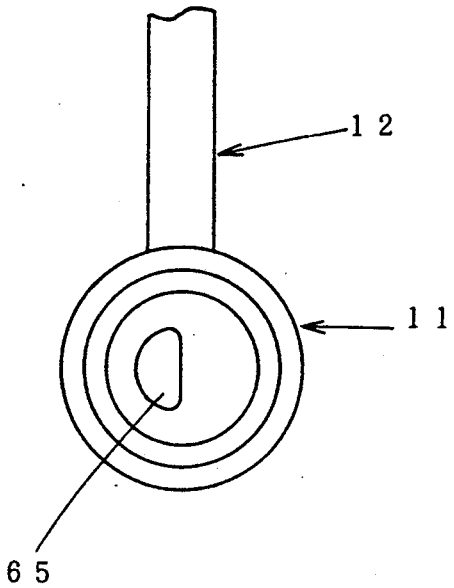
FIG. 15 is a left side of a second embodiment.
Figure 16:
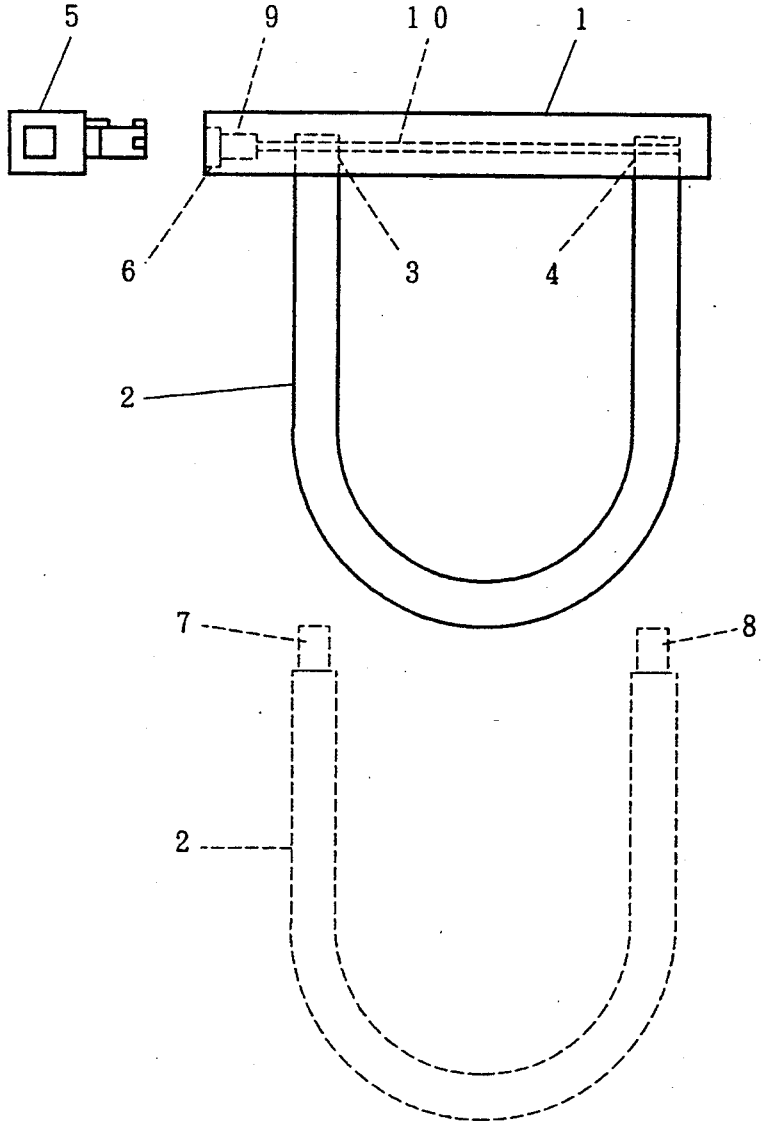
FIG. 16 PRIOR ART
FIG. 16 is a front view showing an appearance of a conventional example.

In the above-mentioned first embodiment, though the opposite ends of the hook 12 can be separated from the lock body 11, as a second embodiment shown in FIG. 13 to FIG. 15 one end of the hook 12 may be always engaged in a groove 61 formed on the operating plate 32 and retained therein, and only the other end of the hook 12 may be made separable by engaging with and disengaging from the engaging portion 37 formed on the moving plate 30.

In the first embodiment, since the hook 12 and the lock body 11 separate from each other completely, it is easy to attach to the vehicles, while in the second embodiment, since the hook 12 does not separate from the lock body 11 completely, there is no possibility to lose the hook 12.

Also, in the second embodiment shown in FIG. 13 to FIG. 15, an operating member 62 is provided in place of the push button 25. When the operating member 62 is rotated, a bias piece 63 integrated with the operating member 62 presses a cam 64 formed at the end edge of the moving plate 30, and moves the moving plate 30.

Furthermore, in the embodiment shown in the figures, a push button 65 is provided in a body with the operating plate 32 in place of the coin slot 26 of the first embodiment, so as to press the sleeve 46 by the operating plate 32 when the push button 65 is pressed.

Though the embodiment mode of the moving plate 30 and the operating plate 32 is different from the first embodiment, their functions are similar to the first embodiment.

Configurations of the operating shaft 31, dials 48, bushes 49, lock mechanism 53, unlocking code sequence setting mechanism 66 and so on are similar to those of the first embodiment, so their descriptions are omitted.

Now, in the first embodiment, after separating the hook 12 from the lock body 11, the hook 12 is hooked on between a wheel and a vehicle body. Next, the opposite ends of the hook 12 are inserted into the hook insertion holes 23, 24 of the lock body 11 and engaged to the engaging portions 37, 38 of the moving plate 30 for connection with the lock body 11. Thereafter, when any dial 48 is rotated to disorder the unlocking code sequence, since reciprocating motion of the operating shaft 31 is restricted by the lock mechanism 53, movement of the moving plate 30 is prevented and a locked state is retained.

When unlocking, the dials 48 are rotated to align the unlocking code sequence. Thereby, the operating shaft 31 is allowed to reciprocate. Then, when the push button 25 is pressed, the moving plate 30 is pushed and moved, and thereby the engaging portions 37, 38 of the moving plate 30 and the opposite ends of the hook 12 disengage from each other, so that the hook 12 can be drawn out from the hook insertion holes 23, 24.

When changing the unlocking code sequence, a coin is inserted into the coin slot 26 to push the operating plate 32. Thereby, the bushes 49 displace simultaneously and disengage from the dials 48, which can be rotated independently.

After setting the desired codes for every dial 48 in such a manner and changing the fixed angular position of the dials 48 against the bushes 49, when the coin is drawn out from the coin slot 26 to release the biassing force, the bushes 49 are restored and engaged to the dials 48 again, thereby the unlocking code sequence which has been set is fixed.

What is claimed is:

1. A locking apparatus for vehicles comprising:

an elongated, rigid lock body extending in an axial direction between opposite ends thereof;

a hook having one of a single metal bar and a coupled body of a plurality of metal bars, said hook being connected to the lock body in a ring shape such that opposite ends of said hook are coupled with opposite ends of said lock body and at least one end thereof can be separated from the lock body; and said lock body comprising:

a single moving plate which engages with and disengages from a separating end of the hook in response to an external operation, said moving plate being movable substantially in said axial direction of said lock body;

an operating shaft capable of reciprocating with the moving plate and being engaged by said moving plate for reciprocation therewith, said operating shaft being reciprocable substantially in said axial direction of said lock body;

a plurality of dials respectively rotatably disposed on the operating shaft via bushes;

an unlocking code sequence setting mechanism which changes coupling angular positions of the dials against the bushes to variably set an unlocking code sequence, without removing said dials from said operating shaft;

a lock mechanism which allows reciprocating motion of the operating shaft when the dial codes are in an aligned state constituting the unlocking code sequence, and restricts reciprocating motion of the operating shaft in a misaligned state; and said moving plate including:

a side plate extending in said axial direction and directly alongside an axis of said operating shaft, said side plate having a cut-out portion at an end thereof for engaging with said at least one end of said hook, a push plate connected with said side plate for supporting one end of said operating shaft so as to provide that said operating shaft reciprocates with the moving plate, and means on one end of said moving plate and connected to said side plate for engaging with engagement means which causes said moving plate to move substantially in said axial direction of said lock body.

2. A locking apparatus for vehicles in accordance with claim 1, wherein said hook can be separated from said lock body at opposite ends thereof.

3. A locking apparatus for vehicles in accordance with claim 2, wherein said hook is a coupled body of a plurality of metal bars, and connections between said plurality of metal bars permit said metal bars to pivotally move relative to one another.

4. A locking apparatus for vehicles in accordance with claim 1, wherein said hook is constrained by said lock body at one end thereof, while another end can be separated from the lock body.

5. A locking apparatus for vehicles in accordance with claim 4, wherein said hook is a coupled body of a plurality of metal bars, and connections between said plurality of metal bars permit said metal bars to pivotally move relative to one another.

6. A locking apparatus for vehicles in accordance with claim 1, wherein said hook is a coupled body of a plurality of metal bars, and connections between said plurality of metal bars permit said metal bars to pivotally move relative to one another.

7. A locking apparatus for vehicles in accordance with claim 1, wherein said lock body includes a push button for pressing said moving plate for operation.

8. A locking apparatus for vehicles in accordance with claim 1, wherein said lock body includes an operating member for pressing said moving plate for operation.

9. A locking apparatus for vehicles comprising:

an elongated, rigid lock body extending in an axial direction between opposite ends thereof;

a hook having one of a single metal bar and a coupled body of a plurality of metal bars, said hook being connected to the lock body in a ring shape such that opposite ends of said hook are coupled with opposite ends of said lock body and at least one end thereof can be separated from the lock body; and said lock body comprising:

a single moving plate which engages with and disengages from a separating end of the hook in response to an external operation, said moving plate being movable substantially in said axial direction of said lock body;

an operating shaft capable of reciprocating with the moving plate and being engaged by said moving plate for reciprocation therewith, said operating shaft being reciprocable substantially in said axial direction of said lock body;

engagement means, engaging with said moving plate, for moving said moving plate substantially in said axial direction such that said moving plate causes movement of said operating shaft substantially in said axial direction;

a plurality of dials respectively rotatably disposed on the operating shaft via bushes;

an unlocking code sequence setting mechanism which changes coupling angular positions of the dials against the bushes to variably set an unlocking code sequence, without removing said dials from said operating shaft; and a lock mechanism which allows reciprocating motion of the operating shaft when the dial codes are in an aligned state constituting the unlocking code sequence, and restricts reciprocating motion of the operating shaft in a misaligned state; and said moving plate including:

a side plate extending in said axial direction and directly alongside an axis of said operating shaft, said side plate having a cut-out portion at an end thereof for engaging with said at least one end of said hook, a push plate connected with said side plate for supporting one end of said operating shaft so as to provide that said operating shaft reciprocates with the moving plate, and means on one end of said moving plate and connected to said side plate for engaging with said engagement means to cause said moving plate to move substantially in said axial direction of said lock body.

10. A locking apparatus for vehicles in accordance with claim 9, wherein said hook can be separated from said lock body at opposite ends thereof.

11. A locking apparatus for vehicles in accordance with claim 9, wherein said hook is constrained by said lock body at one end thereof, while another end can be separated from the lock body.

12. A locking apparatus for vehicles in accordance with claim 9, wherein said hook is a coupled body of a plurality of metal bars, and connections between said plurality of metal bars permit said metal bars to pivotally move relative to one another.

13. A locking apparatus for vehicles in accordance with claim 9, wherein said means for moving said moving plate includes a push button for pressing said moving plate for operation.

14. A locking apparatus for vehicles in accordance with claim 9, wherein said means for moving said moving plate includes an operating member for pressing said moving plate for operation.

* * * * *